US011104126B2

(12) United States Patent
Kato et al.

(10) Patent No.: US 11,104,126 B2
(45) Date of Patent: Aug. 31, 2021

(54) LIQUID EJECTION APPARATUS, EJECTION CONTROL METHOD, AND LIQUID EJECTION HEAD

(71) Applicant: CANON KABUSHIKI KAISHA, Tokyo (JP)

(72) Inventors: Maki Kato, Fuchu (JP); Yoshinori Misumi, Tokyo (JP); Yuzuru Ishida, Yokohama (JP); Tsubasa Funabashi, Yokohama (JP); Takahiro Matsui, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/592,423

(22) Filed: Oct. 3, 2019

(65) Prior Publication Data

US 2020/0114643 A1 Apr. 16, 2020

(30) Foreign Application Priority Data

Oct. 12, 2018 (JP) ..... JP2018-193584

(51) Int. Cl.
*B41J 2/045* (2006.01)
*B41J 2/14* (2006.01)

(52) U.S. Cl.
CPC ..... *B41J 2/0458* (2013.01); *B41J 2/04513* (2013.01); *B41J 2/04541* (2013.01); *B41J 2/14072* (2013.01); *B41J 2/14129* (2013.01)

(58) Field of Classification Search
CPC .. B41J 2/0458; B41J 2/04513; B41J 2/14129; B41J 2/14072; B41J 2/04541
See application file for complete search history.

(56) References Cited

U.S. PATENT DOCUMENTS

| | | | | |
|---|---|---|---|---|
| 7,344,218 | B2 | 3/2008 | Imanaka et al. | |
| 7,841,678 | B2 | 11/2010 | Imanaka et al. | |
| 8,002,374 | B2 | 8/2011 | Imanaka et al. | |
| 8,491,087 | B2 * | 7/2013 | Sakai | B41J 2/16517 347/22 |
| 9,114,612 | B2 | 8/2015 | Kato et al. | |
| 9,682,552 | B2 | 6/2017 | Kato et al. | |
| 10,434,777 | B2 | 10/2019 | Kato et al. | |

FOREIGN PATENT DOCUMENTS

JP 2009-051146 A 3/2009

* cited by examiner

*Primary Examiner* — Geoffrey S Mruk
(74) *Attorney, Agent, or Firm* — Venable LLP

(57) ABSTRACT

A liquid ejection apparatus, an ejection control method, and a liquid ejection head are capable of suppressing shortening of the life of the liquid ejection head and maintaining stable ejection operation. For this purpose, voltage is applied to upper electrodes and counter electrodes so as to make the voltage at the upper electrodes lower than the voltage at the counter electrodes before heat generating resistive elements are driven, and voltage is applied to the upper electrodes and the counter electrodes so as to make the voltage at the upper electrodes higher than the voltage at the counter electrodes at the same time as or after the start of driving of the heat generating resistive elements.

16 Claims, 9 Drawing Sheets

LIQUID EJECTION APPARATUS, EJECTION CONTROL METHOD, AND LIQUID EJECTION HEAD

BACKGROUND OF THE INVENTION

Field of the Invention

The present invention relates to a liquid ejection apparatus, an ejection control method, and a liquid ejection head for ejecting a liquid via operation of a heat generating resistive element.

Description of the Related Art

Japanese Laid-Open Patent Application No. 2009-51146 discloses a method in which an electrode with the same polarity as the surface charges of ink colloidal particles (a component in ink) is provided above each heat generating resistive element, and a counter electrode with the opposite polarity is provided at a position spaced from the electrode to free the ink colloidal particles from the heat generating resistive element. Japanese Laid-Open Patent Application No. 2009-51146 further discloses a method involving switching the potential direction between an upper electrode and its counter electrode provided above each heat generating resistive element. Japanese Laid-Open Patent Application No. 2009-51146 discloses that, in cleaning of the electrode, the potential direction is switched as appropriate to facilitate detachment of charged matter in the ink electrically adsorbed to the electrode's surface and thereby facilitate the cleaning.

Here, there is a case where an upper electrode with the same polarity from colloidal particles (a component in the liquid) and a counter electrode with the opposite polarity as the colloidal particles are disposed in each liquid chamber. In this case, if the liquid contains charged matter with the opposite polarity from the colloidal particles, this charged matter may possibly attach to the surface of the upper electrode. If the charged matter attaches, it may possibly be burned by the heat of the heat generating resistive element, thereby lowering the ejection speed.

SUMMARY OF THE INVENTION

In view of this, the present invention provides a liquid ejection apparatus, an ejection control method, and a liquid ejection head capable of suppressing shortening of the life of a liquid ejection head and maintaining stable ejection operation.

To achieve this object, a liquid ejection apparatus of the present invention is a liquid ejection apparatus comprising: a liquid ejection unit comprising a liquid chamber capable of storing a liquid, a heat generating resistive element configured to generate energy for ejecting the liquid inside the liquid chamber, a first electrode provided in the liquid chamber so as to cover the heat generating resistive element and being capable of forming an electric field in the liquid inside the liquid chamber, and a second electrode provided in the liquid chamber at a position different from a position of the first electrode and being capable of forming an electric field in the liquid inside the liquid chamber; and a voltage application unit capable of applying a voltage between the first electrode and the second electrode, wherein in a standby state before the heat generating resistive element is driven, the voltage application unit applies a voltage between the first electrode and the second electrode so as to make potential at the first electrode lower than potential at the second electrode, and in a driven state at a same time as or after start of driving of the heat generating resistive element, the voltage application unit applies a voltage between the first electrode and the second electrode so as to make the potential at the first electrode higher than the potential at the second electrode.

According to the present invention, it is possible to implement a liquid ejection apparatus, an ejection control method, and a liquid ejection head capable of suppressing shortening of the life of a liquid ejection head and maintaining stable ejection operation.

Further features of the present invention will become apparent from the following description of exemplary embodiments with reference to the attached drawings.

DESCRIPTION OF THE EMBODIMENTS

An embodiment of the present invention will be described below with reference to the drawings.

Figure 1:
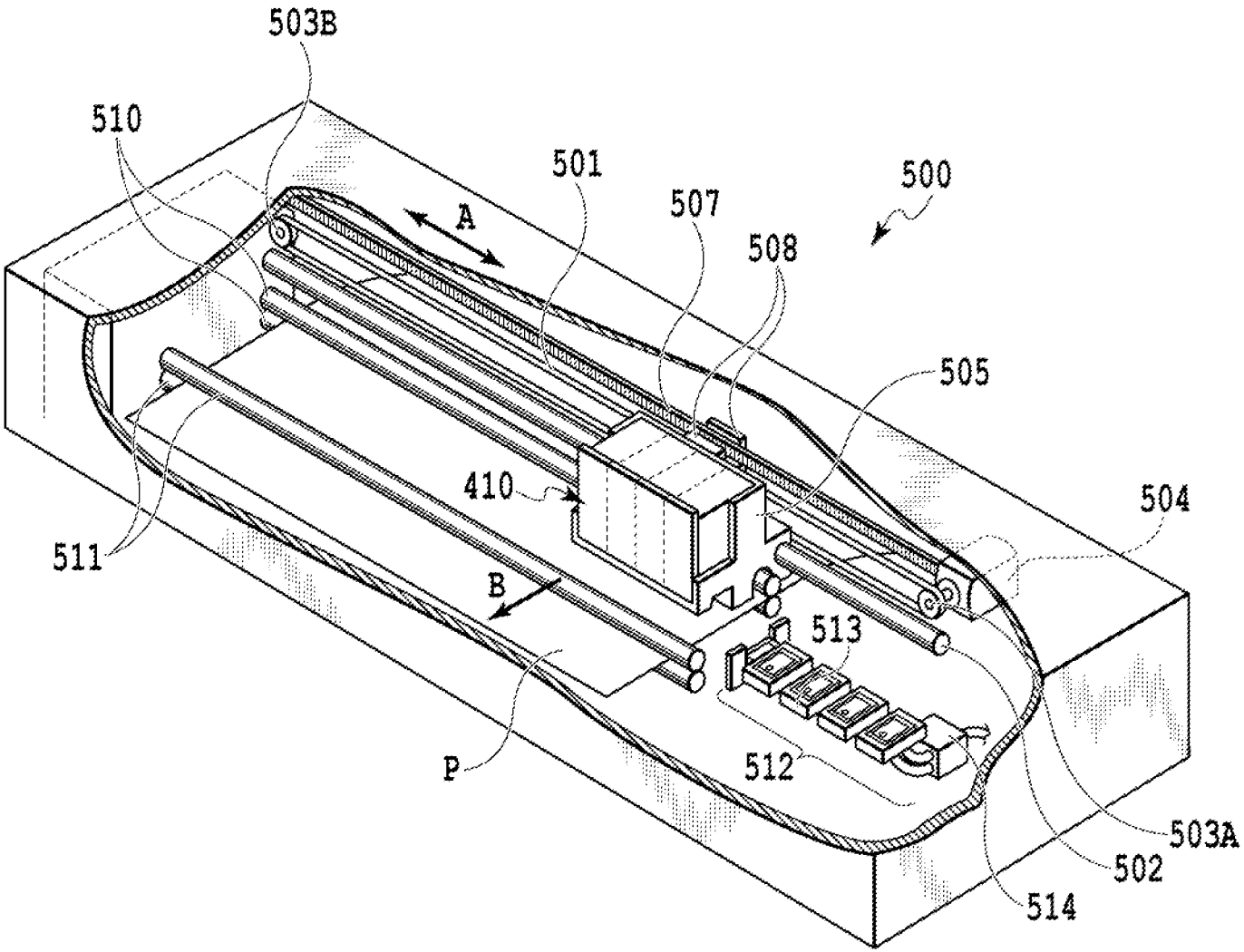
FIG. 1 is a schematic configuration diagram showing a liquid ejection apparatus.

FIG. 1 is a schematic configuration diagram showing a liquid ejection apparatus 500 to which the present embodiment is applicable. The liquid ejection apparatus 500 comprises a carriage 505 configured to be movable in a main scanning direction indicated by arrow A. The liquid ejection apparatus 500 performs printing by ejecting liquids (hereinafter also referred to as inks) onto a print medium from ejection heads mounted in the carriage 505. The carriage 505, in which are mounted four head units 410 that eject cyan, magenta, yellow, and black inks, respectively, is attached to a part of an endless belt 501 wrapped around the peripheries of a drive pulley 503A and a driven pulley 503B. As the drive pulley 503A, which uses a carriage motor 504 as its drive source, rotates, the endless belt 501 turns around the drive pulley 503A and the driven pulley 503B and the carriage 505 moves reciprocally in the main scanning direction (the direction of arrow A) while being guided and supported by a guide shaft 502.

An encoder sensor 508 is attached to the carriage 505. The encoder sensor 508 detects slits in a linear scale 507 extending in the direction of arrow A. A control unit of the liquid ejection apparatus 500 recognizes the position of the carriage 505 in the direction of arrow A on the basis of the result of detection of the linear scale 507 by the encoder sensor 508.

A print medium P is nipped by an upstream conveyance roller pair 510 and a downstream conveyance roller pair 511, so that the print medium P remains flat and smooth at a position facing the ejection opening surfaces of the head units 410 in which ejection openings for ejecting the liquids are provided. The upstream conveyance roller pair 510 and the downstream conveyance roller pair 511 are rotated by a conveyance motor to be described later to convey the print medium in the direction of arrow B.

While driving the carriage motor 504, the control unit of the liquid ejection apparatus 500 ejects the inks toward the print medium P from the head units 410 in accordance with ejection data on the basis of the result of detection by the encoder sensor 508. As a result, an image of one band is formed on the print medium P. Thereafter, the control unit drives the conveyance motor to convey the print medium P in the direction of arrow B by a distance corresponding to one band. By alternately repeating a main scanning for printing and a conveyance operation as above, images are formed on the print medium P in a step-by-step manner.

At the end on the side in the direction of arrow A where the carriage motor 504 is provided, a home position is set where a recovery unit 512 for maintaining each ejection head ejection condition in a good condition is disposed. The recovery unit 512 is provided with a cap member 513 for protecting the ejection opening surfaces of the liquid ejection heads, a suction pump 514 for forcibly discharging inks from the ejection openings by depressurizing the inside of the cap member, and so on.

Figure 2:
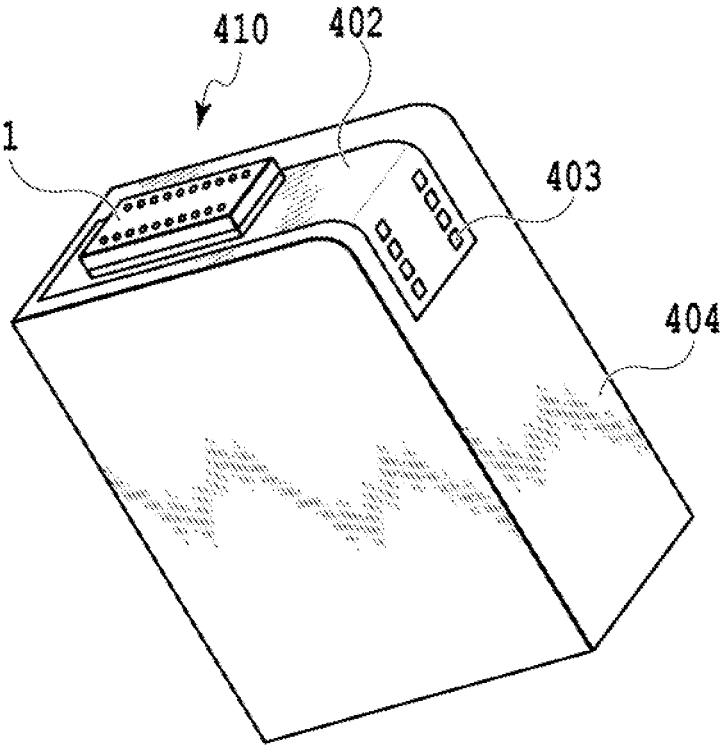
FIG. 2 is a perspective external view showing a head unit of one color.

FIG. 2 is a perspective external view showing the head unit 410 of one color. The head unit 410 includes a tank 404 storing the liquid therein and a liquid ejection head 1 that ejects the liquid (hereinafter also referred to simply as the ejection head) and is attached to the tank 404. Wiring tape 402 for supplying ejection data and electric power to the ejection head 1 is disposed on a part of the periphery of the head unit 410. Also, in the wiring tape 402, there are formed contacts 403 for electrically connecting the head unit 410 to the main body of the liquid ejection apparatus 500 in a state where the head unit 410 is mounted in the carriage 505.

Note that while the head unit 410 with the ejection head 1 and the tank 404 integrated with each other is exemplarily shown here, the ejection head 1 and the tank 404 may be separated. In this case, only the ejection head 1 may be mounted in the carriage 505, and the liquid may be supplied to the ejection head 1 through a tube or the like from a tank fixed at a given position inside the liquid ejection apparatus. In this case, the ejection head 1 itself can be a single chip that handles the inks of the four colors. Further, the type and the number of inks that can be handled are not limited to the above. The configuration may be equipped with an ink of only a single color or a greater number of types of inks.

Figure 3:
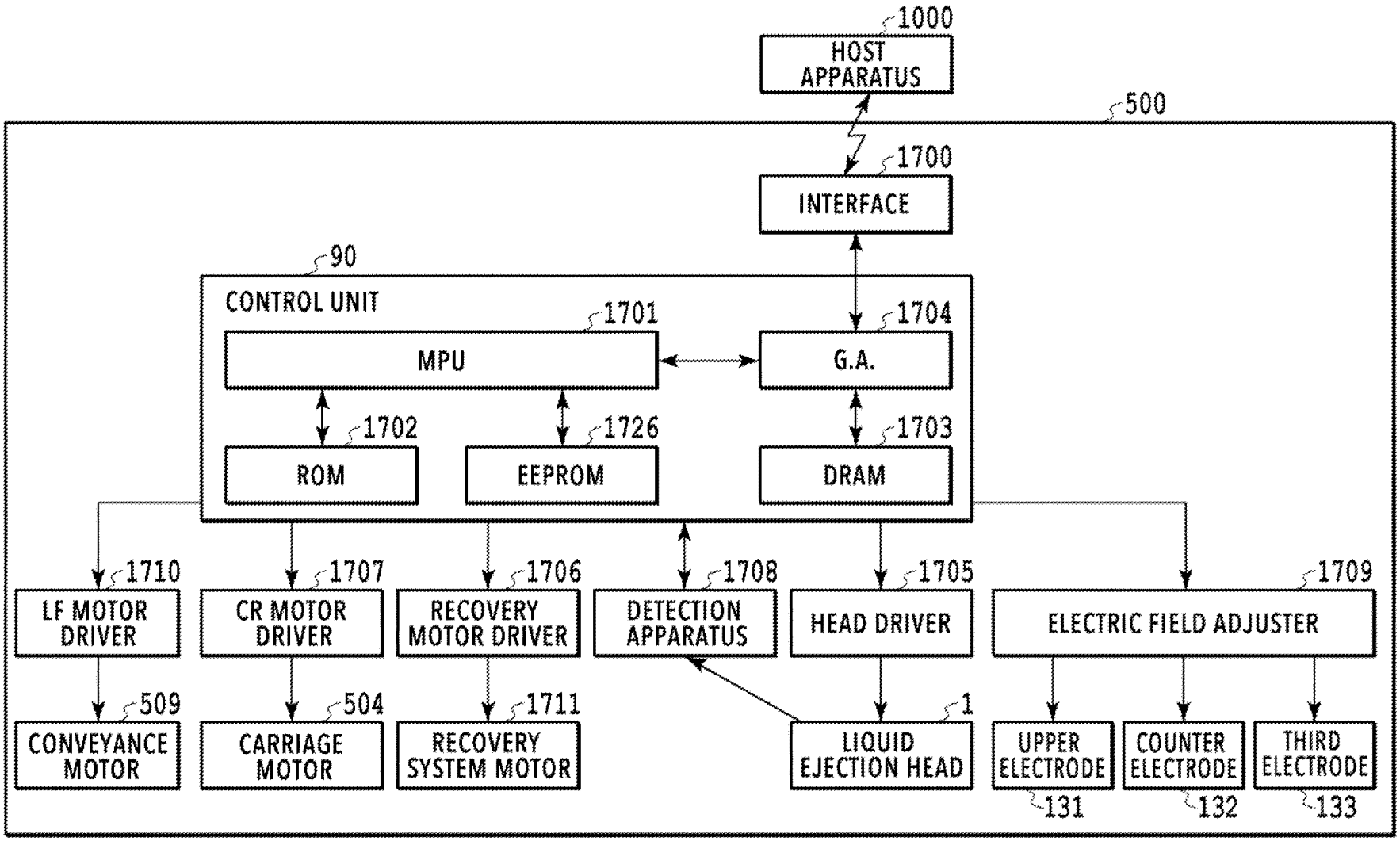
FIG. 3 is a block diagram showing a control system in the liquid ejection apparatus.

FIG. 3 is a block diagram showing a control system in the liquid ejection apparatus 500. An interface 1700 transmits and receives information between the liquid ejection apparatus 500 and an externally connected host apparatus 1000. Specifically, the interface 1700 receives print commands and image data from the host apparatus 1000 and provides status information on the liquid ejection apparatus 500 to the host apparatus 1000, for example. The host apparatus 1000 can be a computer, a digital camera, a scanner, or a mobile terminal. In a case where the host apparatus 1000 generates a print command, the command is inputted into the liquid ejection apparatus 500 through the interface 1700 along with image data.

A control unit 90 has an MPU 1701, an ROM 1702, a DRAM 1703, an EEPROM 1726, and a gate array (G.A.) 1704 and controls the entire apparatus. The EEPROM 1726 is a memory which, even in a powered-off state, stores information necessary for the liquid ejection apparatus 500 at the next power-on. The gate array 1704 controls data transfer between the interface 1700, the MPU 1701, and the DRAM 1703 in accordance with instructions from the MPU 1701.

The MPU 1701 performs various control processes in accordance with programs and parameters stored in the ROM 1702 with the DRAM 1703 as a work area. For example, the MPU 1701 moves the carriage 505 in the direction of arrow A by driving the carriage motor 504 via a CR motor driver 1707. In doing so, the MPU 1701 transfers ejection data from the DRAM 1703 and drives the ejection heads 1 via a head driver 1705. As a result, an image of one line is printed on the print medium P. Also, each time a main scanning is performed for the printing of one line, the MPU 1701 conveys the print medium P in the direction of arrow B by a predetermined distance by driving a conveyance motor 509 via an LF motor driver 1710. By alternately repeating a main scanning for printing and a conveyance operation as above, images are formed on the print medium P on the basis of the image data received from the host apparatus.

The MPU 1701 executes suction recovery processing on the ejection heads 1 by driving a recovery system motor 1711 via a recovery motor driver 1706 with appropriate timing such as after finishing a printing operation for one page. Further, the MPU 1701 adjusts the potentials at upper electrodes (first electrode) 131 and counter electrodes (second electrode) 132 disposed in the ejection heads 1 via an electric field adjuster 1709.

The ROM 1702 stores various parameters to be used by the MPU 1701 to perform various control processes as described above. Examples of the various parameters include the shape of voltage pulses to be applied to heat generating resistive elements in the ejection heads 1, voltages to be applied (applicable) to the upper electrodes 131 and the counter electrodes 132 and the timings of the application, the speed of conveyance of the print medium P, the speed of scanning of the carriage 505, and so on.

Figure 4:
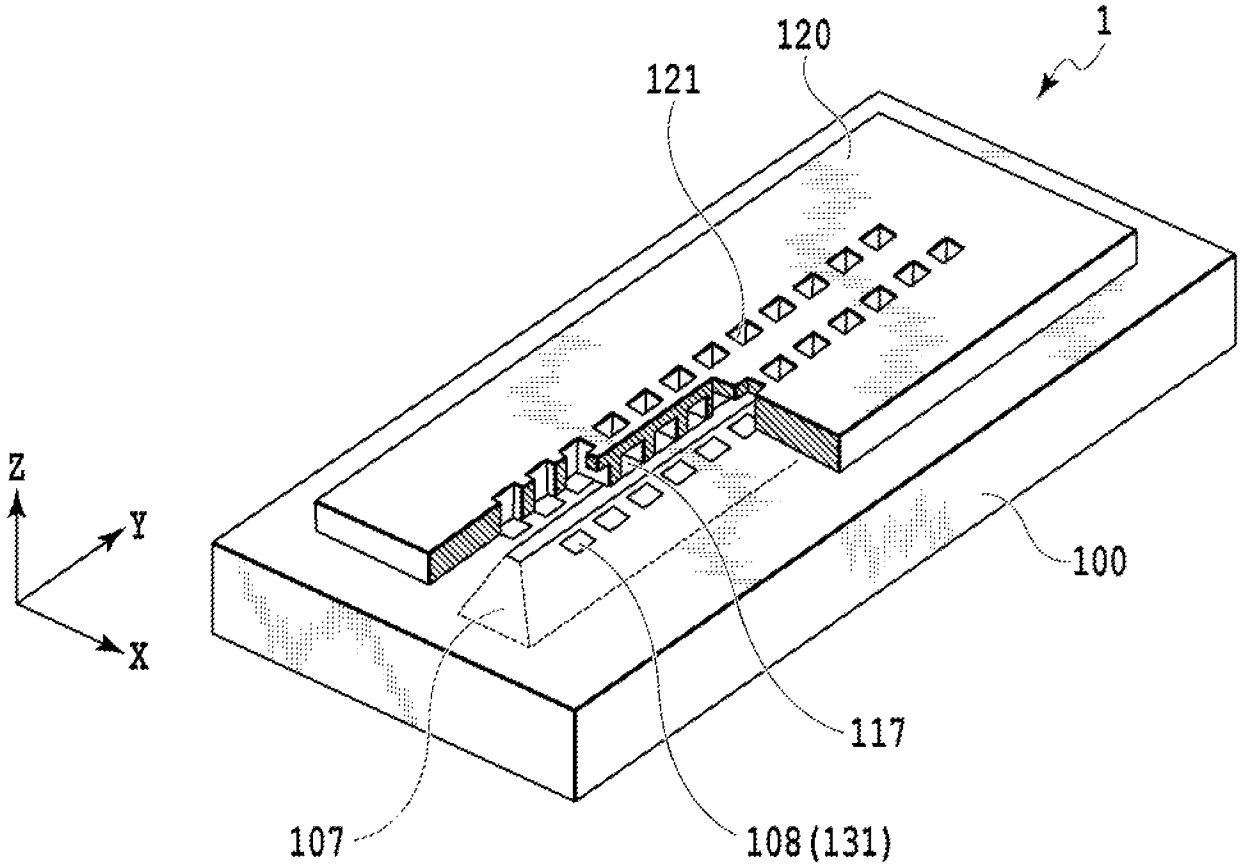
FIG. 4 is a perspective view showing the ejection head.

FIG. 4 is a perspective view showing an ejection head 1. The ejection head 1 comprises a head board 100 and a channel forming member 120. The channel forming member 120 is joined to the surface of the head board 100 in which heat applying portions 108 are formed. In the head board 100, a supply opening 107 is formed as a through-hole through which to supply ink supplied from the back surface (the opposite side in the direction of arrow Z) to the channel forming member 120. In the present embodiment, the supply opening 107 extends in the longitudinal direction (the direction of arrow Y). The heat applying portions 108 for generating thermal energy to eject ink are arrayed on both sides of the supply opening 107 along the supply opening 107 at predetermined intervals in the direction of arrow Y.

Ejection openings 121 for ejecting ink are formed in portions of the channel forming member 120 corresponding to the individual heat applying portions 108 of the head board 100. Also, in the channel forming member 120, liquid chambers 117 are formed which are channels guiding ink supplied from the supply opening 107 to the individual ejection openings and being capable of storing the ink. The ink supplied from the supply opening 107 is guided to the individual liquid chambers 117 by capillary force and forms a meniscus near each ejection opening 121. Then, as voltage pulses are applied to heat generating resistive elements in accordance with ejection data, the corresponding heat applying portions 108 are abruptly heated, thereby causing film boiling of the ink in contact with the heat applying portions 108. By the effect of the film boiling, a predetermined amount of ink is ejected from the ejection openings 121.

Figure 5:
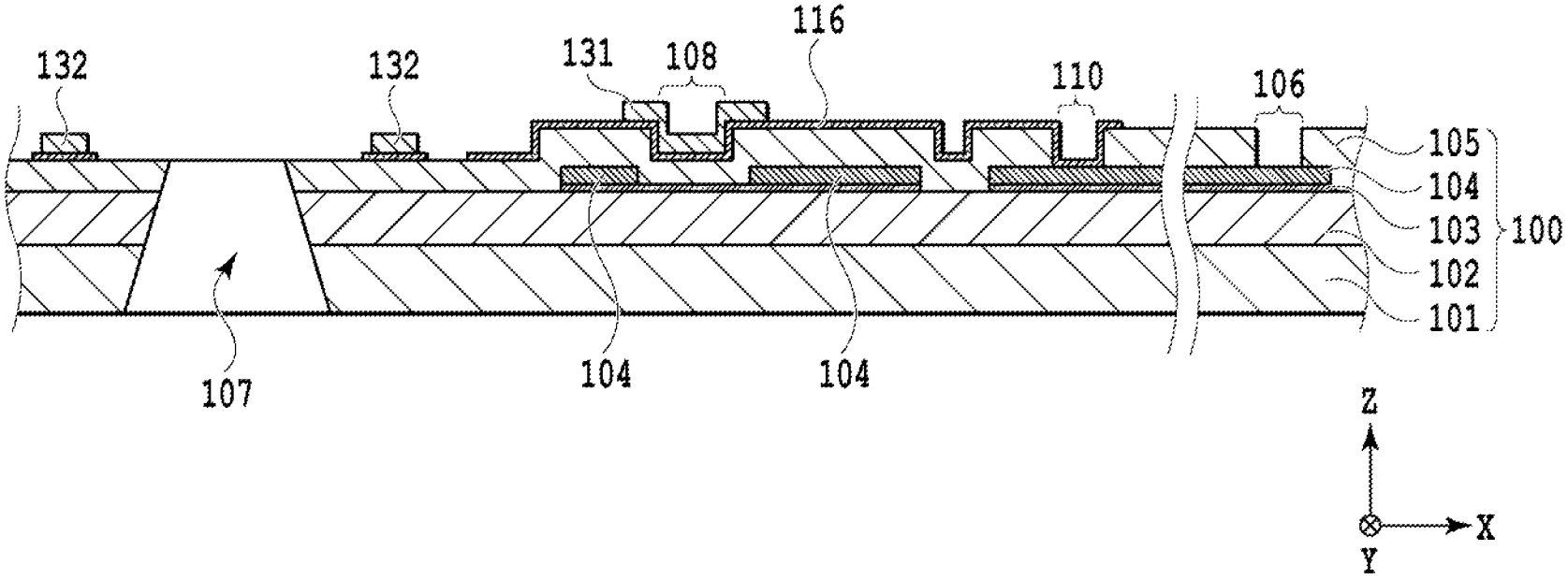
FIG. 5 is a cross-sectional view showing a part of a head board.

FIG. 5 is a cross-sectional view showing a part of the head board 100. In the head board 100, a heat accumulation layer 102 made of an insulating material such as $SiO_2$ or SiN is disposed on a silicon substrate 101, and a heat generating resistive element layer 103 made of a publicly known material such as TaSiN is provided on part of the surface of the heat accumulation layer 102. Moreover, a wiring layer 104 made of a metallic material such as Al, Al—Si, or Al—Cu is formed on part of the surface of each heat generating resistive element layer 103. As a voltage is applied to a layer formed of a heat generating resistive element layer 103 and a wiring layer 104, a current flows in the region where the wiring layer 104 is present along the wiring layer 104. On the other hand, in the region where the wiring layer 104 is not present, a current flows through the heat generating resistive element layer 103, so that this region functions as a heat applying portion 108 (so-called a heat generating resistive element).

In the head board 100, each layer formed of a heat generating resistive element layer 103 and a wiring layer 104 includes a region including a heat applying portion 108, and a region electrically separated from the heat applying portion 108. The regions including the heat applying portions 108 are used as wirings for performing ejection operations in accordance with ejection data. On the other hand, the regions not including the heat applying portions 108 are used as wirings for applying a voltage to the upper electrodes and the counter electrodes.

A protective layer 105 made of an insulating material such as $SiO_2$ or SiN is formed further on the heat accumulation layer 102, including the regions where the heat generating resistive element layers 103 and the wiring layers 104 are disposed. In actual use of the ejection head 1, ink flowing through the liquid chambers 117 is in contact with the front surface of the head board 100. However, with the protective layer 105 disposed, the heat generating resistive element layers (hereinafter also referred to as the heat generating resistive elements) 103 and the wiring layers 104 are not exposed to the ink but only generated heat is transferred to the ink. Note that, in end regions of the head board 100 to which the channel forming member 120 is not laminated, through-holes are formed in which the protective layer 105 is not disposed and from which the wiring layers are exposed, and serve as terminals 106 from which a current is caused to flow to the wiring layers 104. The material of the protective layer 105 is not limited to the above, but is required to have film properties such as high thermal resistance, mechanical properties, chemical stability, alkali resistance, and so on since it is heated to around 700° C. and also contacts ink.

On part of the surface of the protective layer 105, there is disposed an adhesion layer 116 for improving the adhesion between the protective layer 105 and electrode layers. The adhesion layer 116 is laminated on regions of the protective layer 105 where the upper electrodes 131, which are first electrodes, and the counter electrodes 132, which are second electrodes, are disposed in the form of a layer. The adhesion layer 116 also serves as part of wiring paths for applying a voltage to the electrode layers, and is electrically connected to the wiring layers at through-holes 110 formed in the protective layer 105.

The material of this adhesion layer 116 is not particularly limited as long as it is an electrically conductive material having high thermal conductivity that allows heat generated by the heat applying portions 108 to be transferred to the ink with as low a loss as possible. However, in a case where the adhesion layer 116 partly contacts the liquid in the liquid chambers, its material is preferably liquid resistant. For example, a metallic material such as tantalum or niobium can be preferably utilized since it is capable of forming a passivation film on its surface even with a high voltage applied into the ink in cleaning to be described later.

Next, the two types of electrodes in the present embodiment will be described. The upper electrodes 131, which are the first electrodes, are electrodes laminated so as to cover the tops of the heat applying portions 108. In the present embodiment, before the heat generating resistive elements are driven, the upper electrodes 131 function as electrodes having a lower potential than the potential of the counter electrodes 132, which are the second electrodes, mainly to avoid attracting negatively charged matter in the ink. After the start of driving of the heat generating resistive elements, the upper electrodes 131 function as electrodes having a higher potential than the potential of the counter electrodes 132 to avoid attraction of positively charged matter in the ink. In addition to the above, the upper electrodes 131 are required to protect the heat applying portions 108 from physical and chemical impacts and also to have thermal conductivity that enables instantaneous transfer of heat generated by the heat applying portions 108 to the ink, and are required to be of a material that does not form a firm oxide film when heated to around 700° C. Such a material of the upper electrode 131 may be Ir or Ru alone, an alloy of Ir and another metal, or an alloy of Ru and another metal, for example.

Before the heat generating resistive elements are driven, the counter electrodes 132, which are second electrodes, function as positive electrodes having a higher potential than the potential of the upper electrodes 131 to keep the negatively charged matter in the ink away from the upper electrodes 131. After the start of driving of the heat generating resistive elements, the counter electrodes 132 function as negative electrodes having a lower potential than the potential of the upper electrodes 131 to keep the positively charged matter in the ink away from the upper electrodes 131. To stably maintain electric fields (enable formation of stable electric fields) between the counter electrodes 132 and the upper electrodes 131, the material of the counter electrodes 132 preferably contains a metal that does not easily form an oxide film with low conductivity and is not dissolved by electrochemical reactions. In order to reduce the manufacturing load, it is preferable to form the counter electrodes 132 by using the same material as the upper electrodes 131 in the same manufacturing process.

Figure 6:
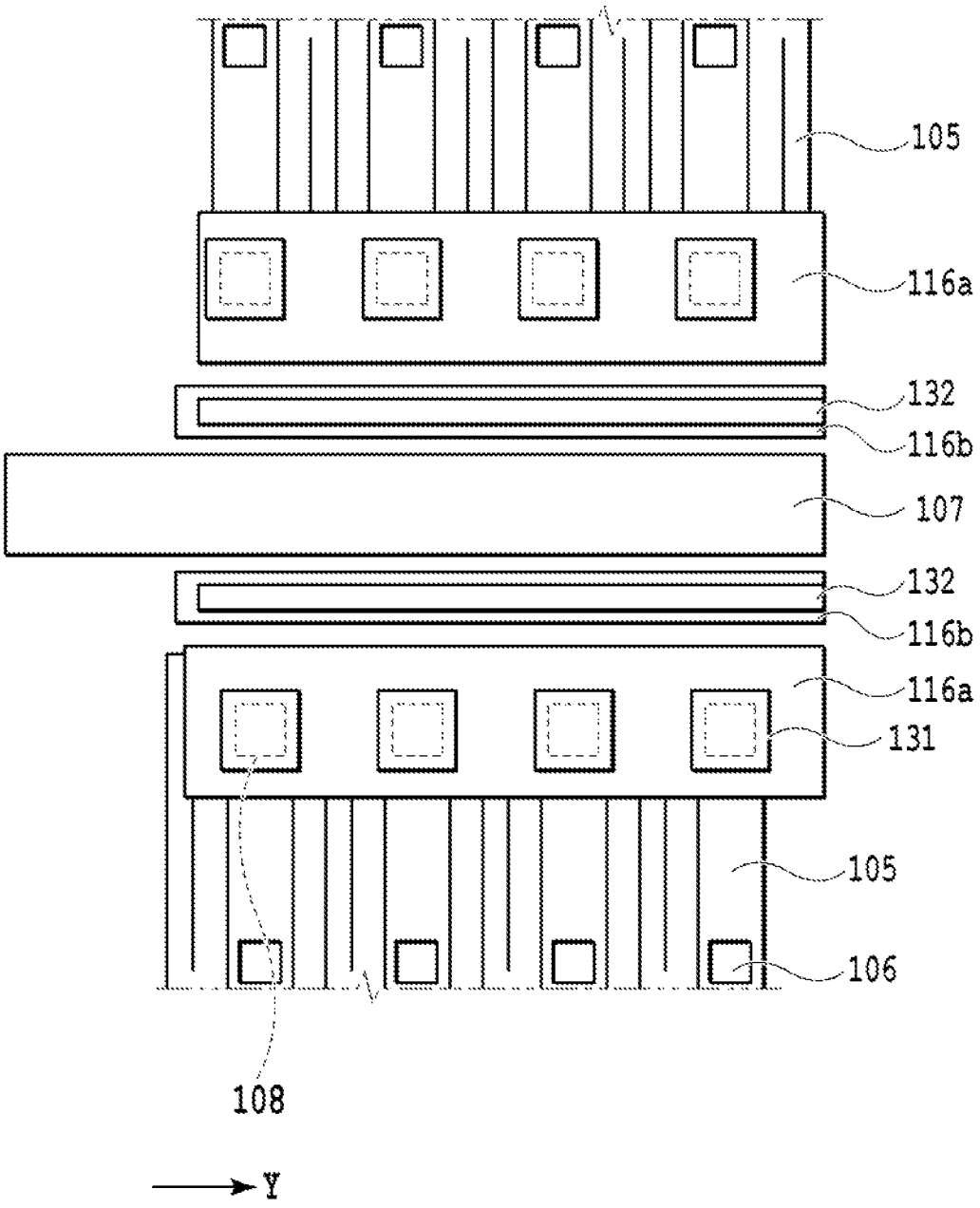
FIG. 6 is a diagram showing the layout of wirings in the head board.

FIG. 6 is a diagram showing the layout of wirings in the head board 100. The plurality of heat applying portions 108 are arrayed on both sides of the ink supply opening 107, which extends in the direction of arrow Y, and adhesion layers **116*a* are formed such that each covers the plurality of heat applying portions 108 on one side. Moreover, the upper electrodes 131 are formed on the adhesion layers 116*a* at positions corresponding to the individual heat applying portions 108. Also, on both sides of the ink supply opening 107 and between the two arrays of upper electrodes 131, adhesion layers 116*b* and the counter electrodes 132 (second electrodes) are formed so as to extend in the direction of arrow Y The wiring layers 104 to which the upper electrodes 131 are connected through the adhesion layers 116*a* (see FIG. 5) and the wiring layers 104 to which the counter electrodes 132** are connected through the adhesion layers 116*b* are electrically separated from each other. These wirings are each connected to an individual terminal 106.

Figure 7:
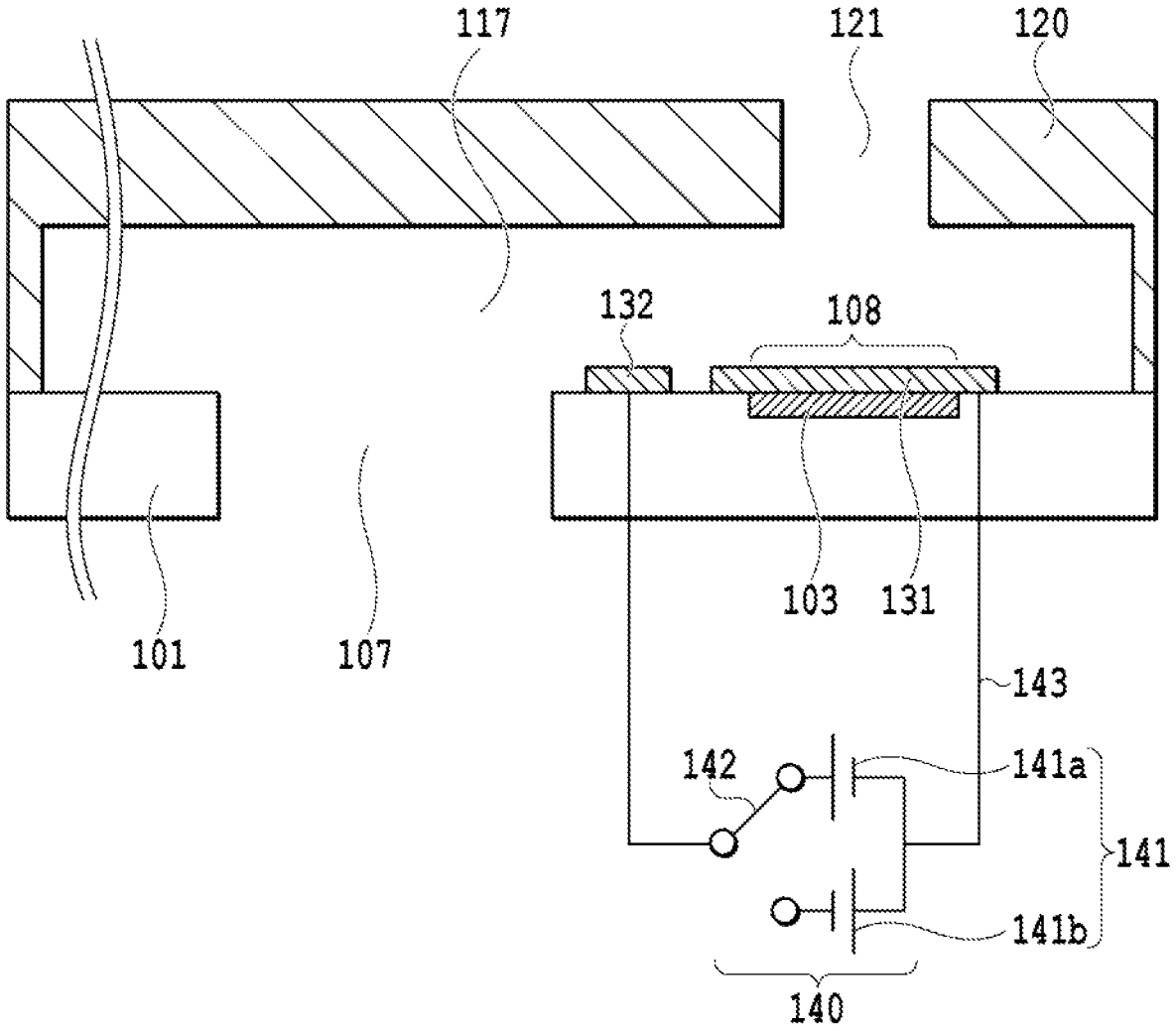
FIG. 7 is a diagram showing a circuit around an upper electrode and a counter electrode.

FIG. 7 is a diagram showing a circuit around an upper electrode 131 and its corresponding counter electrode 132. The upper electrode 131 and the counter electrode 132 are electrically connected by a wiring path 143 that extends through a power supply 141 and a switch 142, and a closed electric circuit is formed with the ink inside the liquid chamber 117 interposed between the upper electrode 131 and the counter electrode 132. In the present embodiment, such a closed circuit will be referred to as a burn suppression unit 140. In the burn suppression unit 140, the upper electrode 131, the counter electrode 132, and the wiring layer 104 (see FIG. 5) forming part of the wiring path 143 are provided in the ejection head 1 while the remaining part of the wiring path 143, the switch 142, and the power supply 141 are provided outside the ejection head 1. However, the switch 142 can be provided to the ejection head 1.

In the present embodiment, a liquid containing a component with negative polarity and a component with positive polarity is ejected. For example, a liquid containing a color material being ions with negative polarity or colloidal particles with negative charges on their surfaces, and ions with positive polarity or colloidal particles with positive charges on their surfaces is ejected.

The burn suppression unit 140 is configured such that one of two circuits can be selectively chosen by switching the switch 142. In the burn suppression unit 140, with the switch 142 turned to a power supply 141*a* side, the upper electrode 131 turns to a negative electrode and the counter electrode 132 turns to a positive electrode by the effect of the power supply 141*a*. As a result, the negative ions or colloidal particles with negative polarity in the ink inside the liquid chamber 117 move away from the upper electrode 131 and toward the counter electrode 132. With such an electric field formed, the ink component with negative polarity is unlikely to attach to the heat applying portion 108. On the other hand, the positive ions or colloidal particles with positive polarity approach the upper electrode 131. At this point, the heat generating resistive element 103 has not been driven, so that the temperature of the heat generating portion is low and therefore burn does not occur.

Figure 8:
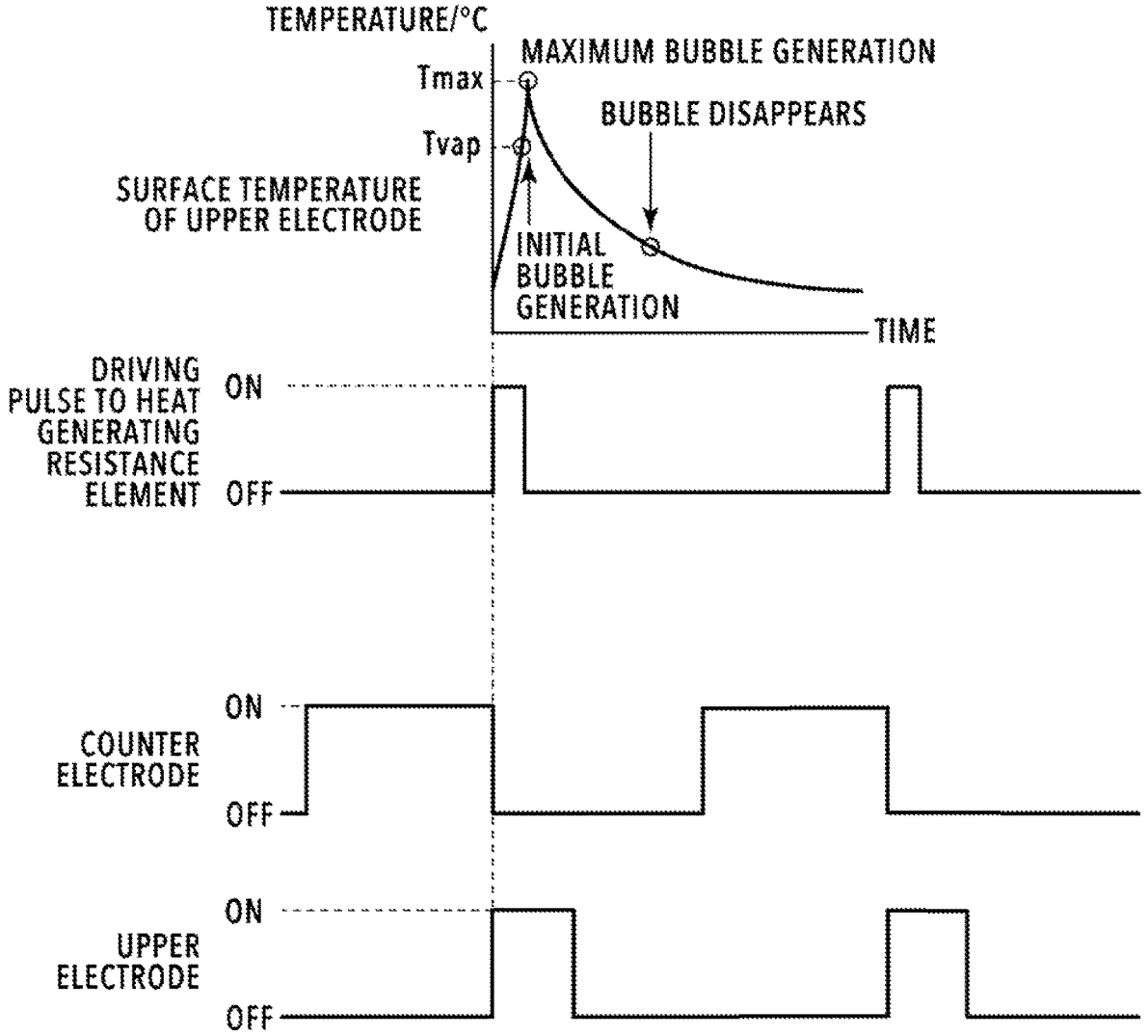
FIG. 8 is a timing chart showing the states of voltages at the upper electrode and the counter electrode.

FIG. 8 is a timing chart showing the states of the voltages at the upper electrode 131 and the counter electrode 132. In the present embodiment, the voltage application between the upper electrode 131 and the counter electrode 132 is controlled according to the liquid ejection, that is, the driving of the heat generating resistive element 103. Specifically, in a state before the heat generating resistive element 103 is driven (standby state), the switch 142 is turned to the power supply 141*a* side. Then, a driving pulse for causing a current to flow in is inputted into the heat generating resistive element 103 (driven state), and at the same time as inputting the driving pulse, the switch 142 is switched to a power supply 141*b* side. As a result, the upper electrode 131 turns to a positive electrode and the counter electrode 132 turns to a negative electrode.

Thus, before a bubble is generated at the heat applying portion 108, the positive ions or colloidal particles with positive polarity in the liquid move away from the upper electrode 131 toward the counter electrode 132. This suppresses burn of the positive ions or colloidal particles with positive polarity onto the upper electrode 131 due to abrupt rise in temperature of the heat applying portion 108 to high temperature. In particular, among the components in the ink, particles with small particle sizes or high-mobility metal ions such as those with large charge amounts can be sufficiently moved away from the upper electrode 131 in a short time.

Also, when the switch 142 is switched, the negative ions and colloidal particles with negative polarity in the ink instantaneously start moving toward the upper electrode 131. However, the top of the upper electrode 131 is immediately covered with an air bubble. This suppresses attachment of the negative ions or colloidal particles with negative polarity to the upper electrode 131 in the state where the heat applying portion 108 is hot, and therefore also suppresses burn of the negative ions or colloidal particles with negative polarity onto the upper electrode 131. In particular, in a case of low-mobility particles such as a pigment dispersion having larger particle sizes than the above metal ions (in a case where the molecular weight of the pigment dispersion is sufficiently larger than the molecular weight of the metal ions), the particles are unlikely to attach to the upper electrode 131 in such a short time.

Note that the timing to switch the switch 142 to the power supply 141*b* side is preferably the same timing as the timing to input a driving pulse to the heat generating resistive element 103 but may be slightly delayed as long as it is before the upper electrode 131 is covered with an air bubble. That is, as long as the timing to switch the switch 142 to the power supply 141*b* side is before the upper electrode 131 is covered with an air bubble, the positively charged particles can move in the ink away from the upper electrode 131, and therefore a burn suppression effect can be achieved. Nonetheless, in order to minimize charged matter with negative polarity approaching the upper electrode 131, it is desirable to set the voltage of the power supply 141*b* as low as possible and set the application time short. Specifically, it is preferable to make the voltage value between the upper electrode 131 and the counter electrode 132 in the driven state lower than the voltage value between the upper electrode 131 and the counter electrode 132 in the standby state.

Also, it is preferable to make the time for which a voltage is applied between the upper electrode 131 and the counter electrode 132 in the driven state shorter than the time for which a voltage is applied between the upper electrode 131 and the counter electrode 132 in the standby state. Also, it is preferable to turn off the upper electrode 131 after turning off the driving pulse to the heat generating resistive element 103 (after stopping applying the driving voltage). As described above, the negative ions or colloidal particles with negative polarity are moved away from the upper electrode 131 before driving the heat generating resistive element 103, and the positive ions or colloidal particles with positive polarity are moved away from the upper electrode 131 in the period from the start of the driving to the maximum bubble generation. This reduces attachment of the positive ions or colloidal particles with positive polarity onto the upper electrode 131 in the state where the heat applying portion is hot.

Such a configuration reduces attachment of the positive ions or colloidal particles with positive polarity onto the upper electrode 131 and also onto the counter electrode 132 at the same time. If the polarities are not inverted as in the present embodiment, so that the counter electrode 132 remains higher in voltage than the upper electrode 131, the negatively charged particles are attracted to the counter electrode 132 and attach to the counter electrode 132. Consequently, the area of the counter electrode 132 in which it can function as an electrode becomes smaller, so that the desired effect cannot be achieved.

However, with the configuration capable of inverting the polarities of the upper electrode 131 and the counter electrode 132 as in the present embodiment, the counter electrode 132 does not remain higher in voltage. By the inversion of the polarities, the attracted negatively charged particles move away from the counter electrode 132. As a result, a stable burn suppression effect is achieved continuously.

Meanwhile, in the application of voltage between the upper electrode 131 and the counter electrode 132 for the burn suppression, applying a high voltage may possibly cause an electrochemical reaction between the ink and the upper electrode 131 and counter electrode 132 and cause dissolution of the constituent material of the electrodes into the ink. To avoid this, a voltage at such a level as not to cause the electrochemical reaction is applied for the burn suppression. For example, in a case where an iridium film is provided as the upper electrode 131 and the counter electrode 132, the voltage between the upper electrode 131 and the counter electrode 132 is preferably 2.5 V or lower. Also, to make the charged matter in the ink stably repel the upper electrode 131 and the counter electrode 132, the voltage to be applied therebetween is preferably 0.10 V or higher.

Also, the present embodiment employs a circuit configuration in which the switch 142 is provided between the upper electrode 131 and the counter electrode 132 and the switch 142 is switched to invert the polarities of the upper electrode 131 and the counter electrode 132. However, the circuit configuration is not limited to the above. Specifically, the circuit configuration only needs to be capable of inverting the polarities of the upper electrode 131 and the counter electrode 132. For example, the configuration may be such that one of the upper electrode 131 and the counter electrode 132 is kept at a ground potential and the polarity of the voltage to be applied to the other electrode is inverted.

Also, in the present embodiment, a description has been exemplarily given of a serial-type inkjet printing apparatus with each of the ejection heads 1 for four colors mounted in the mobile carriage 505. However, the configuration is not limited to the above. Specifically, a head board 100 and a channel forming member 120 as shown in FIG. 4 may be connected in series to other ones of those to form a long ejection head that ejects an ink of a single color or inks of different colors. Meanwhile, in a case of a single-color long ejection head, this long ejection head may be prepared for four colors and fixed and used in a full-line-type inkjet printing apparatus which ejects inks at a predetermined frequency onto a conveyed print medium. As described above, the present invention functions effectively in ejection heads that eject liquid containing matter having electric polarities among ejection heads that eject liquid by using heat generating resistive elements.

EXAMPLES

A plurality of test examples carried out to check the advantageous effect of the present invention will be described below along with a comparative example.

(Test 1)

Figure 9A:
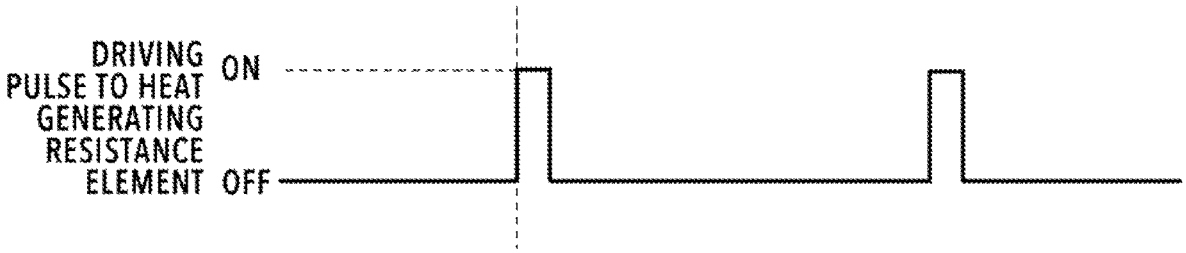
FIGS. 9A to 9C are timing charts of application of driving pulses to a heat generating resistive element and voltages to the upper electrode and the counter electrode.
Figure 9B:
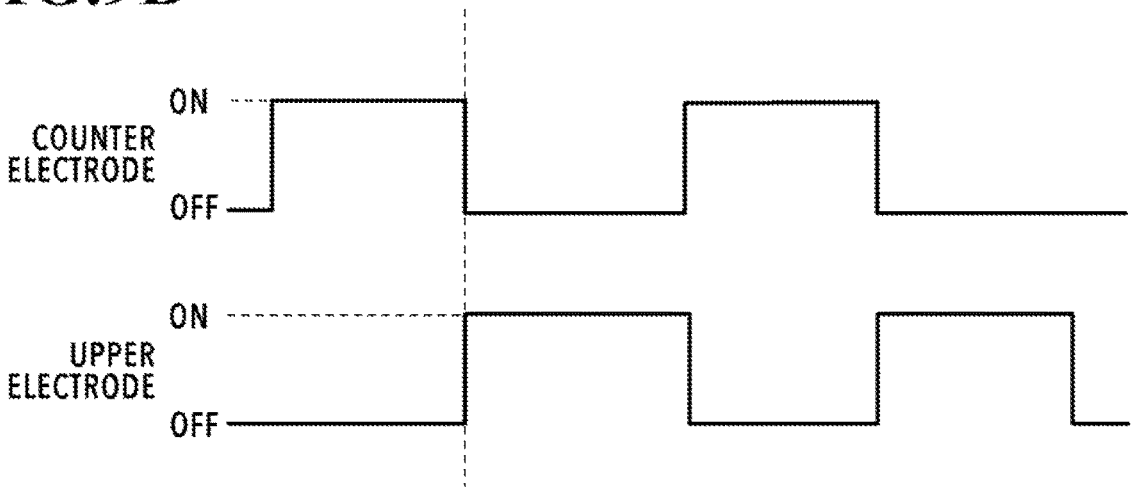
Figure 9C:
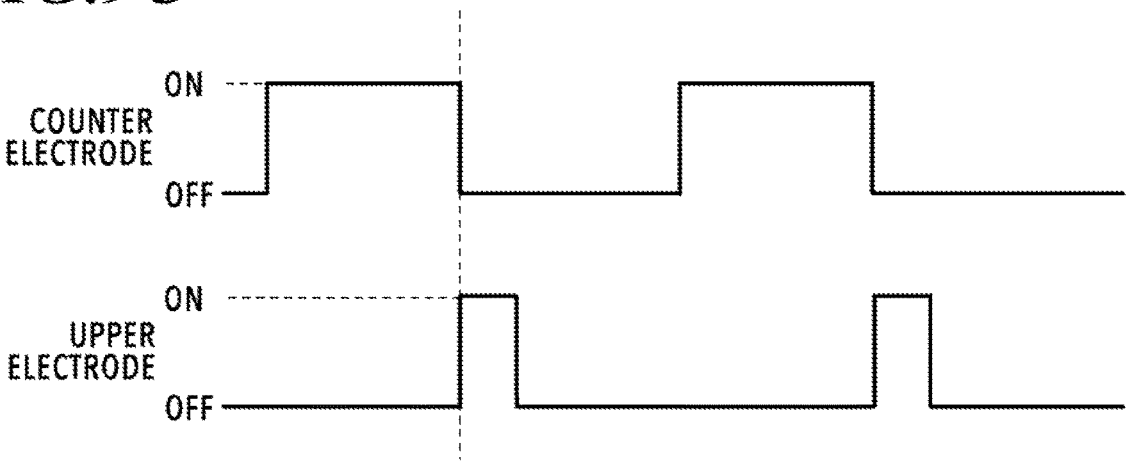

FIGS. 9A to 9C are timing charts of the application of voltages to the upper electrodes and the counter electrodes with respect to driving pulses to the heat generating resistive elements used in the tests. For the ejection head used in test 1, a heat accumulation layer 102 made of $SiO_2$, a heat generating resistive element layer 103 made of TaSiN, a wiring layer 104 made of Al, and a protective layer 105 made of SiN were sequentially laminated on a silicon substrate 101. In this process, the wiring layer 104 was partially removed by etching, and the portions from which the heat generating resistive element layer 103 was exposed were defined as heat applying portions 108 for generating ejection energy. Then, tantalum was formed to a thickness of 100 nm on the protective layer 105 as an adhesion layer 116, on which an iridium film was formed to a thickness of 50 nm. The iridium film was patterned to form upper electrodes 131 and counter electrodes 132. As a result, a head board 100 was formed. Further, a channel forming member 120 was formed and other necessary terminals were formed. As a result, an ejection head 1 was completed.

A head unit formed by connecting a tank 404 storing a cyan pigment ink to this ejection head was attached to a carriage 505 of a liquid ejection apparatus 500. Note that in this test 1 and test 2 and the comparative example to be described below, a cyan pigment ink was used which contained a pigment dispersion with negative polarity and copper ions with positive polarity. Then, among the timings to drive the heat generating resistive elements shown in FIG. 9A, a voltage of 1.5 V was applied to turn the counter electrodes to positive electrodes before the voltage at the heat generating resistive elements was turned on, and a voltage of 0.5 V was applied to turn the upper electrodes to positive electrodes at the same time as when the voltage at the heat generating resistive elements was turned on, as shown in FIG. 9B. Meanwhile, a pulse width of 0.4 μsec and a driving frequency of 7.5 kHz were used as the heater driving conditions shown in FIG. 9A. The ON time of the counter electrodes and the ON time of the upper electrodes shown in FIG. 9B were 70 μsec and 63 μsec, respectively. Under these conditions, the ejection head was caused to perform $10^9$ ejection operations. Thereafter, the inside of the liquid chambers was replaced with a clear ink, and the surface condition was observed.

The result showed that no burns or attached matter were found on the heat applying portions 108, and no attached matter was found on the counter electrodes 132 either. Thereafter, a normal printing operation was performed in accordance with image data, and an output image with good quality was confirmed.

(Test 2)

Unlike the ejection head in test 1, the ejection head used in test 2 was completed as an ejection head with a configuration including the upper electrodes 131, the counter electrodes 132, and switches between their terminals.

Using this ejection head with a cyan pigment ink, a liquid ejection apparatus 500 was caused to perform ejection. Among the timings to drive the heat generating resistive elements shown in FIG. 9A, a voltage of 1.5 V was applied to turn the counter electrodes to positive electrodes before the voltage at the heat generating resistive elements was turned on, as shown in FIG. 9C. Further, a voltage of 0.5 V was applied to turn the upper electrodes to positive electrodes at the same time as when the voltage at the heat generating resistive elements was turned on. Thereafter, a time period was set in which the voltage at the upper electrodes was turned off with the counter electrodes kept turned off. Meanwhile, a pulse width of 0.4 μsec and a driving frequency of 7.5 kHz were used as the heater driving conditions shown in FIG. 9A. The ON time of the counter electrodes and the ON time of the upper electrodes shown in FIG. 9C were 100 μsec and 10 μsec, respectively, and the time from when the upper electrodes were turned off to when the counter electrodes were turned on before the next driving of the heaters was 23 μsec. Under these conditions, the ejection head was caused to perform $10^9$ ejection operations.

Thereafter, the inside of the liquid chambers was replaced with a clear ink, and the surface condition was observed. The result showed that no burns or attached matter were found on the heat applying portions 108, and no attached matters were matter was found on the counter electrodes 132 either.

Thereafter, $10^9$ ejections were further performed. After $2\times10^9$ ejections in total were finished, the inside of the liquid chambers was replaced with a clear ink, and the surface condition was observed again. The result showed that no attached matter was found on the surfaces of the heat applying portions 108 and the counter electrodes 132. Thereafter, a normal printing operation was performed in accordance with image data, and an output image with good quality was confirmed.

In this test, the switch elements disposed in the board were used to accurately control the times for which voltages were applied. Hence, the time for which the upper electrodes were turned to positive electrodes was set shorter. This made it possible to sufficiently suppress burn of the negative ions or colloidal particles with negative polarity. Accordingly, the initial quality was maintained in the images outputted from the printing apparatus.

(Comparative Example)

Using an ejection head similar to that in test 1 with a cyan pigment ink, a liquid ejection apparatus 500 was caused to perform ejection. The ejection head was caused to perform $10^9$ ejection operations by applying a voltage of 1.5 V between the upper electrodes 131 and the counter electrodes 132 to turn the counter electrodes 132 to positive electrodes without switching the polarities at the ejection timings. Thereafter, a normal printing operation was performed in accordance with image data, and an output image with quality deteriorated from the initial quality was confirmed. Further, the inside of the liquid chambers was replaced with a clear ink, and the surface condition was observed. The heat applying portions 108 were discolored to brown. Moreover, burn of attached matter was found on them. Furthermore, an ink component was attached thinly to the surfaces of the counter electrodes 132. From a compositional analysis performed on the brown matter on the heat applying portions, it was found to be Cu. This is considered to be the result of precipitation of copper ions contained in the ink onto the surfaces of the heat applying portion 108 in the form of burn.

As described above, voltage is applied to the upper electrodes and the counter electrodes so as to make the voltage at the upper electrodes lower than the voltage at the counter electrodes before the heat generating resistive elements are driven, and voltage is applied to the upper electrodes and the counter electrodes so as to make the voltage at the upper electrodes higher than the voltage at the counter electrodes at the same time as or after the start of driving of the heat generating resistive elements. This makes it possible to implement a liquid ejection apparatus, an ejection control method, and a liquid ejection head capable of suppressing shortening of the life of a liquid ejection head, and maintaining stable ejection operation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-193584 filed Oct. 12, 2018, which is hereby incorporated by reference herein in its entirety.

What is claimed is:

1. A liquid ejection apparatus comprising:

a liquid ejection unit comprising:

a liquid chamber capable of storing a liquid, a heat generating resistive element configured to generate energy for ejecting the liquid inside the liquid chamber, a first electrode provided in the liquid chamber so as to cover the heat generating resistive element and being capable of forming an electric field in the liquid inside the liquid chamber, and a second electrode provided in the liquid chamber at a position different from a position of the first electrode and being capable of forming an electric field in the liquid inside the liquid chamber; and a voltage application unit capable of applying a voltage between the first electrode and the second electrode to an extent that no electrochemical reaction occurs between the liquid and the first electrode due to driving of the heat generating resistive element based on ejection data, wherein in a standby state before the heat generating resistive element is driven, the voltage application unit applies a voltage between the first electrode and the second electrode so as to make potential at the first electrode lower than potential at the second electrode, and in a driven state at a same time as or after start of driving of the heat generating resistive element, the voltage application unit applies a voltage between the first electrode and the second electrode so as to make the potential at the first electrode higher than the potential at the second electrode.

2. The liquid ejection apparatus according to claim 1, further comprising a switch provided between the first electrode and the second electrode and being capable of switching a path between the first electrode and the second electrode, wherein the switch is switched according to switching between the standby state and the driven state.

3. The liquid ejection apparatus according to claim 2, wherein the liquid ejection unit comprises the switch.

4. The liquid ejection apparatus according to claim 1, wherein the liquid ejection apparatus ejects a liquid containing i) a color material formed of ions with negative polarity or colloidal particles with negative charges on surfaces thereof and ii) ions with positive polarity or colloidal particles with positive charges on surfaces thereof.

5. The liquid ejection apparatus according to claim 1, wherein the liquid ejection apparatus ejects a liquid containing i) a color material with negative polarity and ii) metallic ions with positive polarity having a lower molecular weight than a molecular weight of the color material.

6. The liquid ejection apparatus according to claim 1, wherein the voltage application unit makes a voltage value between the first electrode and the second electrode in the driven state less than a voltage value between the first electrode and the second electrode in the standby state.

7. The liquid ejection apparatus according to claim 1, wherein the voltage application unit makes a time for which a voltage is applied between the first electrode and the second electrode in the driven state shorter than a time for which a voltage is applied between the first electrode and the second electrode in the standby state.

8. The liquid ejection apparatus according to claim 1, wherein the voltage application unit stops the voltage application between the first electrode and the second electrode in the driven state after driving of the heat generating resistive element is stopped.

9. The liquid ejection apparatus according to claim 1, wherein the voltage application unit applies a voltage of 2.5 V or lower.

10. The liquid ejection apparatus according to claim 9, wherein the first electrode and the second electrode include iridium.

11. The liquid ejection apparatus according to claim 1, wherein the voltage application unit applies a voltage of 0.10 V or higher.

12. An ejection control method of controlling voltage application between a first electrode covering a heat generating resistive element configured to heat a liquid inside a liquid chamber to eject the liquid and a second electrode formed at a position different from a position of the first electrode according to ejection of the liquid, the ejection control method comprising:

controlling voltage application between the first electrode and the second electrode to an extent that no electrochemical reaction occurs between the liquid and the first electrode due to driving of the heat generating resistive element based on ejection data, the controlling voltage application between the first electrode and the second electrode including making potential at the first electrode lower than potential at the second electrode before the heat generating resistive element is driven, and making the potential at the first electrode higher than the potential at the second electrode at a same time as or after start of driving of the heat generating resistive element.

13. A liquid ejection head comprising:

a liquid chamber capable of storing a liquid;

a heat generating resistive element configured to generate energy for ejecting the liquid inside the liquid chamber;

a first electrode provided in the liquid chamber so as to cover the heat generating resistive element and being capable of forming an electric field in the liquid inside the liquid chamber; and a second electrode provided in the liquid chamber at a position different from a position of the first electrode and being capable of forming an electric field in the liquid inside the liquid chamber, wherein before the heat generating resistive element is driven, a voltage is applied between the first electrode and the second electrode so as to make potential at the first electrode lower than potential at the second electrode, and at a same time as or after start of driving of the heat generating resistive element, a voltage is applied between the first electrode and the second electrode so as to make the potential at the first electrode higher than the potential at the second electrode to an extent that no electrochemical reaction occurs between the liquid and the first electrode due to driving of the heat generating resistive element based on ejection data.

14. The liquid ejection head according to claim 13, wherein the voltage applied between the first electrode and the second electrode is 2.5 V or lower.

15. The liquid ejection head according to claim 14, wherein the first electrode and the second electrode include iridium.

16. The liquid ejection head according to claim 13, wherein the voltage applied between the first electrode and the second electrode is 0.10 V or higher.

* * * * *